US007255930B2

(12) United States Patent
Miyake et al.

(10) Patent No.: US 7,255,930 B2
(45) Date of Patent: Aug. 14, 2007

(54) CAP NUT FOR ENVELOPMENT CASTING, CASTING INCLUDING THE CAP NUT AND METHOD OF ENVELOPING THE CAP NUT IN CASTING

(75) Inventors: Takahito Miyake, Kariya (JP); Tomomichi Miura, Kariya (JP); Hiroshi Kobayashi, Kariya (JP); Shuo Uematsu, Kariya (JP)

(73) Assignee: Kabushiki Kaisha Toyota Jidoshokki, Kariya-shi (JP)

( * ) Notice: Subject to any disclaimer, the term of this patent is extended or adjusted under 35 U.S.C. 154(b) by 41 days.

(21) Appl. No.: 11/099,129

(22) Filed: Apr. 4, 2005

(65) Prior Publication Data

US 2005/0217819 A1 Oct. 6, 2005

(30) Foreign Application Priority Data

Apr. 5, 2004 (JP) ..... 2004-110696
Apr. 15, 2004 (JP) ..... 2004-119701

(51) Int. Cl.
*B32B 3/30* (2006.01)
*B32B 3/02* (2006.01)
*B32B 3/06* (2006.01)
*B22D 19/00* (2006.01)
*B22D 19/04* (2006.01)

(52) U.S. Cl. ..... 428/582; 428/573; 428/583; 428/585; 428/591

(58) Field of Classification Search ..... None
See application file for complete search history.

(56) References Cited

U.S. PATENT DOCUMENTS 1,333,880 A * 3/1920 Stine ..... 52/707
1,373,645 A * 4/1921 Bandoly ..... 411/74
1,627,554 A * 5/1927 Fishel et al. ..... 52/700
4,642,964 A * 2/1987 Kellison ..... 52/699

(Continued)

FOREIGN PATENT DOCUMENTS

EP 0 121 031 * 7/1983

(Continued)

OTHER PUBLICATIONS

U.S. Appl. No. 11/064,652, filed Feb. 23, 2005, Miyake, et al.

*Primary Examiner*—John J. Zimmerman
*Assistant Examiner*—Jason Savage
(74) *Attorney, Agent, or Firm*—Morgan & Finnegan L.L.P.

(57) ABSTRACT

A cap nut to be enveloped in a casting made of casting material includes a substantially cylindrical body. The body has a first end and a second end adjacent to a top end surface of the body. The body has a hole and an outer peripheral surface to be enveloped in the casting material. The body has an exposed surface adjacent to the hole at the first end thereof, and the exposed surface is exposed to an outside of the casting. The body has formed in the outer peripheral surface thereof a tapered surface that broadens from the second end of the body toward the first end. The body has formed in the tapered surface a retaining means for preventing the cap nut from falling off from the casting. The body is installable in and removable from a pattern for forming a sand mold at the tapered surface.

12 Claims, 12 Drawing Sheets

U.S. PATENT DOCUMENTS

| | | | | |
|---|---|---|---|---|
| 5,085,026 | A * | 2/1992 | McGill et al. | 52/745.21 |
| 5,160,226 | A * | 11/1992 | Lee, II | 411/72 |
| 5,697,420 | A | 12/1997 | Mori et al. | 164/98 |
| 6,360,781 | B1 * | 3/2002 | Braad | 138/109 |
| 2005/0183838 | A1 * | 8/2005 | Miyake et al. | 164/98 |

FOREIGN PATENT DOCUMENTS

| | | | |
|---|---|---|---|
| FR | 2 691 656 | | 12/1993 |
| GB | 2 103 749 A | * | 2/1983 |
| JP | 10-29210 | * | 2/1998 |
| JP | 2002-192326 | | 7/2002 |

* cited by examiner

CAP NUT FOR ENVELOPMENT CASTING, CASTING INCLUDING THE CAP NUT AND METHOD OF ENVELOPING THE CAP NUT IN CASTING

BACKGROUND

The present invention relates generally to a cap nut to be enveloped in a casting and a casting method for enveloping the cap nut in the casting, and more particularly to a cap nut which is installable in and removable from a pattern for sand mold and a casting method for enveloping the cap nut in the casting.

When a component is assembled to a large or heavy casting, a fastening bolt is often used which is inserted into a cap nut that is enveloped in casting material of the casting. For enveloping a cap nut in a cast portion, casting material or molten metal is poured into a sand mold with a bolt installed into a threaded hole of the cap nut and buried in the sand mold. In the casting method, however, the cap nut expands and contracts under the influence of heat of the casting material and cooling after casting. In addition, part of the casting material may enter between the cap nut and the bolt thereby causing seizure. The expansion and contraction of the cap nut and the seizure of the cap nut and the bolt cause the threaded hole of the cap nut to be damaged or deformed. Therefore, it is necessary to form the threaded hole again using a tap after the casting. Thus, additional work for forming the threaded hole of the cap nut has caused a decrease in productivity and an increase in manufacturing cost.

There has been recently proposed an art for solving such problems. For example, Unexamined Japanese Patent Publication No. 2002-192326 discloses a casting method for enveloping a cap nut 40 in the casting by a full mold process as shown in FIGS. 12A through 12C. The cap nut 40 has formed therein a stepped hole 43 that includes a large-diameter portion 43*a* on the bottom side and a small-diameter portion 43*b* on the opening side. The cap nut 40 has formed therearound adjacent to the large-diameter portion 43*a* a circumferential notch 44 having a V-shaped cross-section. With this circumferential notch 44 as the boundary, the cap nut 40 has a cap nut body 41 on the bottom side thereof and a cylindrical extension 42 on the opposite side.

The casting method for the above cap nut 40 will be now described. The cap nut 40 is initially inserted into a support hole 46 that is formed in an evaporative pattern 45 made of, for example, expanded polystyrene. The cap nut 40 is inserted into the support hole 46 to such a depth that the circumferential notch 44 is positioned flush with the surface of the evaporative pattern 45. After the cap nut 40 is fixed relative to the evaporative pattern 45, a bolt 47 is screwed into the large-diameter portion 43*a*. Thereafter, a sand mold 50 is made so that the sand mold 50 surrounds the evaporative pattern 45 and also that the bolt 47 and the cap nut 40 are partially buried in the sand mold 50. As shown in FIG. 12A, the nut body 40*a* is supported by the evaporative pattern 45, while the cylindrical extension 50*b* is buried in the sand mold 50.

The casting material is then poured into the sand mold 50. The casting material runs in the cavity of the sand mold 50 and replaces the evaporative pattern 45, so that the cap nut 40, which is fixed to the sand mold 50 by the bolt 47, is enveloped in the casting material. Because the hole 43 of the cap nut 40 is then closed by the bolt 47, the casting material does not enter into the hole 43.

As shown in FIG. 12B, the resulting casting 49, which is taken out of the sand mold 50 after cooling, includes a cast portion 52 made of the casting material and the cap nut 40 enveloped in the cast portion 52, and the bolt 47 is still inserted in the cap nut 50. As shown in FIG. 12C, the bolt 47 is sheared at the circumferential notch 44. As a result, the bolt 47 and the cylindrical extension 43*b* of the cap nut 40 are removed, and the body 43*a* of the cap nut 40 remains in the cast portion 52. The sheared surface adjacent to the hole 43 of the nut body 43*a* is positioned flush with the surface of the cast portion 52. A component may be fixed to the casting 49 by using a fastening bolt (not shown) inserted into the small-diameter threaded hole 43*a* of the cap nut 40 that is enveloped in the cast portion 52.

Thus, the above-described casting method contributes greatly to productivity improvement and reduction of manufacturing cost, and the cap nut 40 having the circumferential notch 44 on the outer peripheral surface thereof is appropriate for performing this casting method.

However, this conventional cap nut is used in the full-mold process using an evaporative pattern, but it is not usable in a casting method using a recyclable pattern for sand mold. Additionally, since the conventional cap nut requires the shearing after casting, the outer diameter of the cap nut and the inner diameter of the hole into which the bolt is inserted suitable for the shearing should be determined previously, which inhibits the freedom of establishing the values for such diameters. The sheared surface of the cap nut, which is to be used as a seating face for fitting a component to the casting, tends to be established small in area. Therefore, when a heavy component is to be fitted to the casting, a fastening bolt with a relatively large axial tension cannot be used.

Meanwhile, FIGS. 13A through 13C illustrate another casting method using a resin pattern for sand mold, instead of an evaporative pattern for enveloping a cap nut 40 in the casting. In this casting method, a pattern 58 is used for forming a sand mold 50 and has formed therein a recess 58*a* that corresponds to a desired position where the cap nut 40 is enveloped. The recess 58*a* has a tapered inner surface which is formed such that the recess 58*a* broadens from its bottom toward its opening. A bolt fitting 56 fillable to the recess 58*a* of the pattern 58 is prepared. The bolt fitting 56 has formed therein a threaded hole 57 that receives therein a bolt 47 as a fixing member. The bolt mold 56 has a truncated cone shape so that its outer peripheral surface fits in the recess 58*a*. The bolt fitting 56 is also removable from the recess 58*a*.

The cap nut 40 is substantially cylindrical and has formed in an exposed surface 41*a* thereof a threaded hole 53 that extends in the longitudinal direction of the cap nut 40. The cap nut 40 has formed in the periphery thereof engaging grooves 54 as retaining means for preventing the cap nut 40 from falling off from a cast portion. The cap nut 40 is formed with an inclined portion 55 as a rotation preventing means for preventing the cap nut 40 from rotating relative to the cast portion.

This casting method will be now described. Initially, a locknut 48 is installed on the bolt 47. The bolt 47 is inserted into the bolt fitting 56, and then the bolt fitting 56 is fitted in the recess 58*a* of the pattern 58 to be held in the pattern 58. Then, molding cavity is filled with molding sand in such a way that the molding sand surrounds the pattern 58 and the bolt 47 is buried in the resulting sand mold 50, as shown in FIG. 13A. After the molding sand has been hardened, the pattern 58 is removed from the sand mold 50. Since the bolt 47 is buried in the sand mold 50, the bolt fitting 56 remains in the sand mold 50 after removing the pattern 58. As shown in FIG. 13B, the bolt fitting 56 is removed from the bolt 47. As shown in FIG. 13C, the cap nut 40, which is to be enveloped in the casting, is installed over part of the bolt 47 which protrudes from the surface of the sand mold 50. With the cap nut 40 thus installed, the cap nut 40 is held by the bolt 47 with the exposed surface 41*a* of the cap nut 40 set in contact with the sand mold 50.

Sequentially, casting material is poured into the cavity of the sand mold 50 and runs therein, so that the cap nut 40 held by the sand mold 50 through the bolt 47 is enveloped in the casting material as shown in FIG. 14A. After the casting material has been cooled, a casting 51 is taken out of the sand mold 50 as shown in FIG. 14B. The casting 51 includes a cast portion 52 and the cap nut 40 enveloped in the cast portion 52, and the bolt 47 is still inserted in and held by the cap nut 40. Removing the bolt 47 from the cap nut 40, the casting 51 is made with the cap nut 40 enveloped therein as shown in FIG. 14C.

The envelopment casting of the cap nut 40 as shown in FIGS. 13A through 14C requires removing the bolt fitting 56 from the bolt and installing the cap nut over the bolt after the pattern 58 is removed from the sand mold 50. Such work is troublesome and time-consuming, which prevents improvement of casting productivity and reduction in manufacturing cost.

The present invention is directed to a cap nut for envelopment casting and also to a method of enveloping the cap nut in a casting which are advantageous in that a repeatable pattern is usable for productivity improvement and casting cost reduction and also that the cap nut can have a sufficiently large seating area because of a higher degree of design of the cap nut.

SUMMARY

In accordance with the present invention, a cap nut to be enveloped in a casting made of casting material includes a substantially cylindrical body. The body has a first end and a second end adjacent to a top end surface of the body. The body has a hole and an outer peripheral surface to be enveloped in the casting material. The body has an exposed surface adjacent to the hole at the first end thereof, and the exposed surface is exposed to an outside of the casting. The body has formed in the outer peripheral surface thereof a tapered surface that broadens from the second end of the body toward the first end. The body has formed in the tapered surface a retaining means for preventing the cap nut from falling off from the casting. The body is installable in and removable from a pattern for forming a sand mold at the tapered surface.

The present invention also provides a casting including a cast portion and a cap nut. The cast portion is made of casting material and has an outer peripheral surface. The cap nut is enveloped in the cast portion and includes a substantially cylindrical body having a first end and a second end. The body has a hole and an outer peripheral surface to be enveloped in the casting material. The body has an exposed surface adjacent to the hole at the first end thereof, and the exposed surface is exposed to an outside of the casting. The body has formed in the outer peripheral surface thereof a tapered surface that broadens from the second end of the body toward the first end. The body has formed in the tapered surface a retaining means for preventing the cap nut from falling off from the casting. The body is installable in and removable from a pattern for forming a sand mold at the tapered surface.

The present invention also provides a method of enveloping a cap nut in a casting. The cap nut includes a substantially cylindrical body to be enveloped in the casting. The body has a hole and an exposed surface adjacent to the hole at a first end thereof, and the exposed surface is exposed to an outside of the casting. The method includes the steps of: forming in an outer peripheral surface of the body a tapered surface that broadens from a second end of the body toward the first end; forming a retaining means in the tapered surface for preventing the cap nut from falling off from the casting; inserting a fixing member into the hole; installing the cap nut in a pattern for a sand mold; filling the pattern with molding sand so that the fixing member is buried in the sand mold; supporting the cap nut by the sand mold through the fixing member; removing the sand mold from the pattern; and pouring a casting material into the sand mold so that the outer peripheral surface of the cap nut is enveloped in the casting material.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A first preferred embodiment of a cap nut for envelopment casting and a method for enveloping the cap nut in the casting according to the present invention will be described with reference to FIGS. 1 through 3C.

Figure 1A:
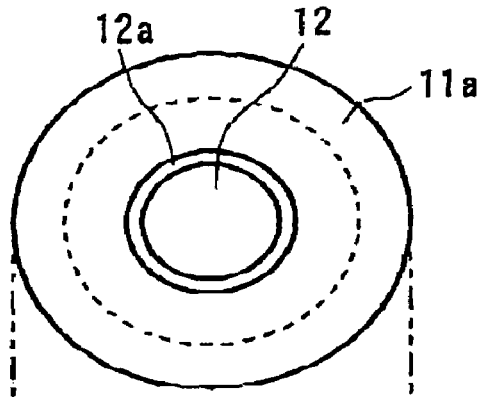
FIG. 1A through 1C respectively show a top view, a side view and a bottom view of a cap nut to be enveloped in a casting according to a first preferred embodiment.
Figure 1B:
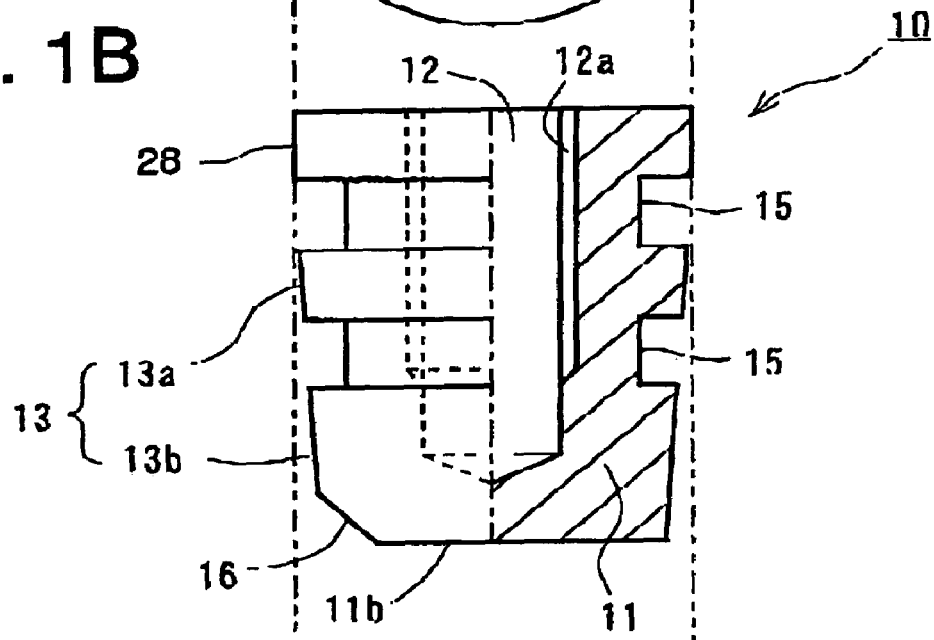
Figure 1C:
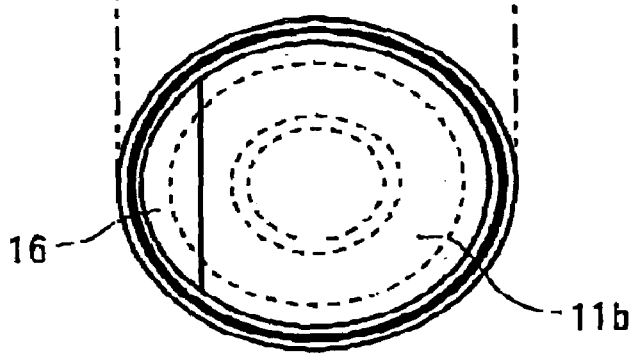

A cap nut 10 will be now described. As shown in FIGS. 1A through 1C, the cap nut 10 includes a cap nut body 11 which is substantially cylindrical and has an exposed surface 11*a* at one end or a first end thereof. The cap nut body 11 has formed therein a hole 12 extending from the above one end toward the other end (a second end) or the bottom surface (a top end surface) 11*b* of the cap nut body 11. The hole 12 is formed with an internal thread 12*a* in which a fastening bolt (not shown) for fixing a component to a casting 23, which will be described later, may be inserted. In addition, the initial thread 12*a* is adapted to receive therein a bolt 17 as a fixing member, which will be described later. Namely, the hole 12 allows the fastening bolt and the bolt 17 to be screwed therein. The exposed surface 11*a* of the cap nut body 11 is larger in diameter than the bottom surface 11*b*, so that the cap nut body 11 has formed in the outer peripheral surface thereof a tapered surface 13 (13*a*, 13*b*) that is tapered toward the bottom surface 11*b* of the cap nut body 11, that is, broadens from the bottom surface 11*b* toward the exposed surface 11*a*. The cap nut body 11 has a non-tapered peripheral surface 28 between the exposed surface 11*a* and the tapered surface 13, and the non-tapered peripheral surface 28 is parallel to the axis of the cap nut body 11. In machining or turning the cap nut 10 by a lathe, the cap nut body 11 is held at the non-tapered surface 28. Thus, the surface 28 serves to facilitate the work of forming the tapered surface of the cap nut.

The cap nut body 11 has formed in the tapered surface 13 annular engaging grooves 15 spaced in axial direction of the cap nut 10 parallel to each other, which function as retaining means for preventing the cap nut 10 from falling off from a cast portion 24 of the casting 23. As shown in FIGS. 1A and 1C, the cap nut body 11 is formed with a planar inclined surface 16 extending between the bottom surface 11*b* and the tapered surface 13*b*. The inclined surface 16 functions as rotation prevention means for preventing the cap nut 10 from rotating relative to the cast portion 24 of the casting 23. The cap nut 10 is made of a ferrous material or a carbon steel. The cap nut 10 is to be enveloped in the cast portion 24 of the casting 23 with all surfaces of the cap nut 10 except its exposed surface 11*a* surrounded by the cast portion 24.

Known bolt and nut are used for both the bolt 17 as the fixing member and a locknut 18 as a cover member. The bolt 17 includes a shank 17*b* having an external thread for engagement with the threaded hole 12 of the cap nut 10, and the locknut 18 has formed therethrough an internal thread hole 18*a* for engagement with the external thread of the bolt 17.

Figure 2A:
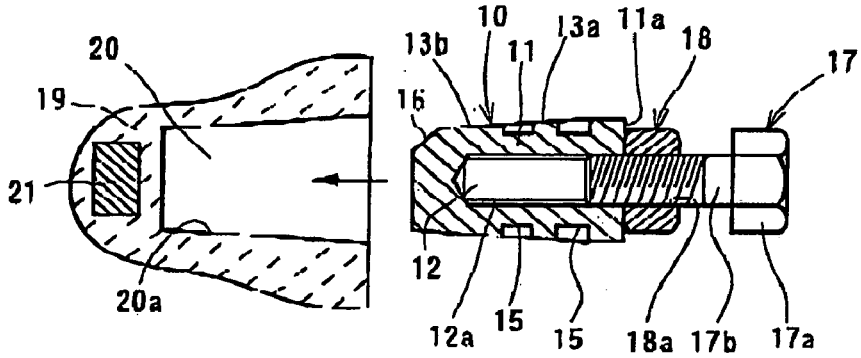
FIGS. 2A through 2C are explanatory views illustrating respective steps of procedure of a casting method before the pouring process in the casting method according to the first preferred embodiment.

The casting method according to the preferred embodiment will be now described with reference to FIGS. 2A through 3C. A pattern 19 that is used for forming a sand mold 22 has formed therein a recess 20 as shown in FIG. 2A. The recess 20 of the pattern 19 is formed with a tapered wall surface 20*a* that is complementary to the tapered surface 13 of the cap nut 10 so that the cap nut 10 is received snugly in the recess 20 of the pattern 10. A magnet 21 is buried in the mold 20 adjacent to the bottom of the recess 20, whose magnetic force acts on the cap nut 10 in the recess 20 so as to prevent the cap nut 10 from falling off from the recess 20, that is, so as to hold the cap nut 10 in the recess 20. Alternatively, adhesive or adhesive tape may be used to secure the cap nut 10 in the recess 20.

The locknut 18 is fitted on the bolt 17 at such a position that the distal end portion of the shank 17*b* of the bolt 17 protrudes from the locknut 17 as shown in FIG. 2A. Subsequently, the protruding portion of the shank 17*b* of the bolt 17 is inserted into the hole 12 of the cap nut 10 in such a way that the exposed surface 11*a* of the cap nut 10 is in close contact with the back surface of the locknut 18, that is, the exposed surface 11*a* is partially covered with the back surface of the locknut 18. Because of this contact, the cap nut 10 is held steadily to the bolt 17 even when the bolt 17 is shallowly inserted into the cap nut 10. The recess 20 is so formed that the outer surface of the pattern 19 is flush with the exposed surface 11*a* of the cap nut 10 when the cap nut 10 with the bolt 17 and the locknut 18 is fitted in the recess 20.

Figure 2B:
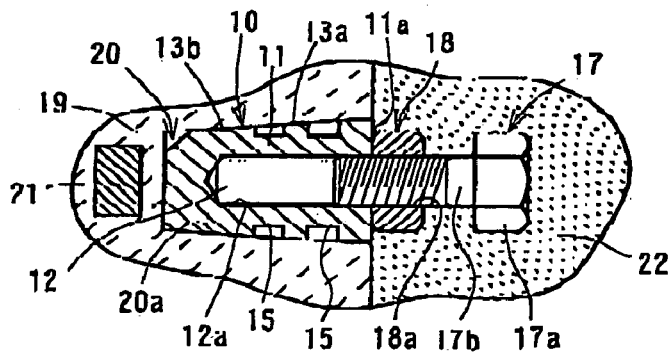
Figure 2C:
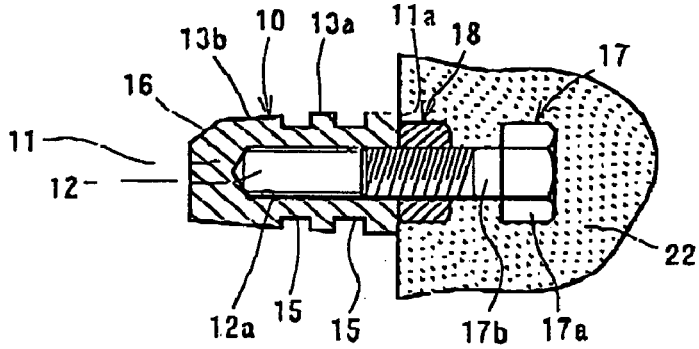

After installing the cap nut 10 in the pattern 19, the cavity of the pattern 19 is filled with molding sand for forming the sand mold 22 as shown in FIG. 2B. A portion of the shank 17*b*, a head 17*a* of the bolt 17 and the locknut 18 are covered with the molding sand and then buried in the sand mold 22. In the first preferred embodiment, the molding sand contains furan-based resin as hardener, so that the sand mold 22 made of such molding sand has strong shape retention after hardening. Accordingly, the sand mold 22 retains its shape without collapsing when it is removed from the pattern 19, as shown in FIG. 2C. The cap nut 10 is supported by the sand mold 22 through the bolt 17 and the locknut 18. Since the pattern 19 has the tapered wall surface 20*a* in the recess 20 which is complementary to the tapered surface 13 of the cap nut 10 and the cap nut 10 is held to the sand mold 22, the cap nut 10 can be separated easily from the pattern 19 against the magnetic force of the magnet 21 in removing the pattern 19 from the sand mold 22.

Casting material or molten metal is subsequently poured into the sand mold 22. Cast iron such as gray cast iron is used as the casting material in the first preferred embodiment. Alternatively, metals other than the ferrous metals, such as aluminum-based metals, copper-based metals are usable.

Figure 3A:
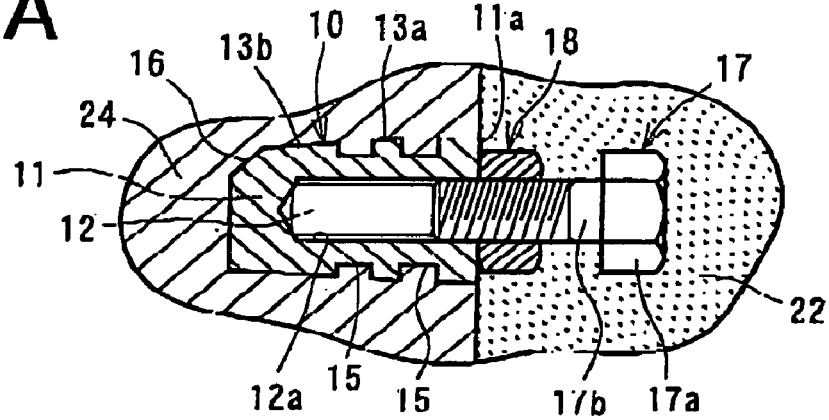
FIGS. 3A through 3C are explanatory views illustrating respective steps of procedure of the casting method after the pouring process until finishing the casting in the casting method according to the first preferred embodiment.

As shown in FIG. 3A, the cap nut 10 is enveloped in the casting material with all surfaces thereof except its exposed surface 11*a* surrounded by the casting material. Because the exposed surface 11*a* of the cap nut 10 and the back surface of the locknut 16 are kept in close contact with each other when the casting material is poured, the molten casting material neither enters therebetween, nor reaches the hole 12 of the cap nut 10.

Figure 3B:
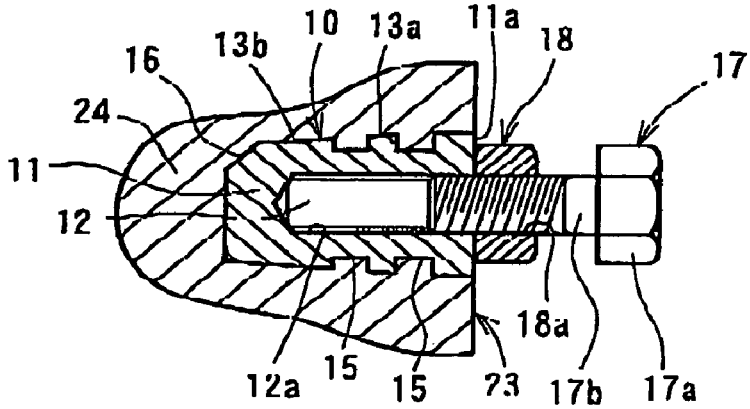

Pouring a predetermined amount of casting material into the sand mold, allowing the poured casting material to be cooled, and removing the sand mold 22 after the cooling, the casting 23 is then formed with the cap nut 10 enveloped therein, as shown in FIG. 3B. The resulting casting 23 has the cast portion 24 that is formed of the cooled casting material and the cap nut 10 that is enveloped in the cast portion 24 and that receives therein the bolt 17.

Figure 3C:
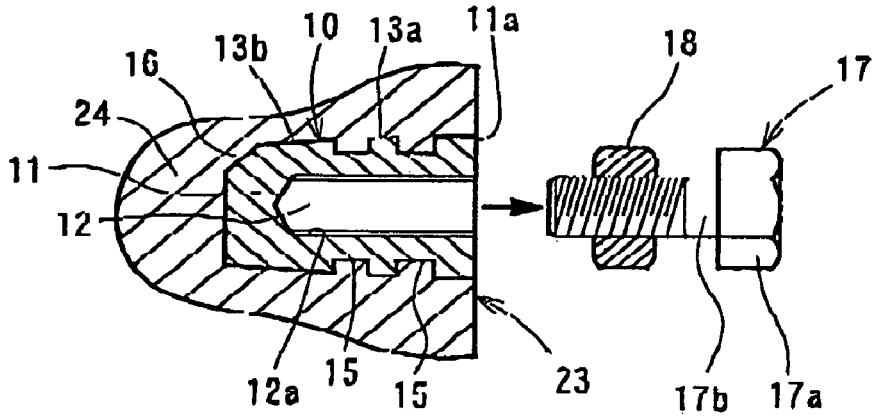

As shown in FIG. 3C, the casting 23 is finished by removing the bolt 17 together with the locknut 18 from the cap nut 10. The removed bolt 17 may be reused several times as the fixing member. The locknut 18 may also be reused as the cover member.

With the bolt 17 removed from the cap nut 10, the exposed surface 11*a* and the outer peripheral surface of the cast portion 24 are substantially flush with each other, and the exposed surface 11*a*, with which the back surface of the locknut 18 had been in contact as shown in FIG. 3A, is flat and smooth. The cap nut 10, which is enveloped in the cast portion 24, does not fall off from the cast portion 24 due to the engagement between the engaging grooves 15 of the cap nut body 11 and the cast portion 24. The provision of the inclined portion 16 in the cap nut body 11 prevents the cap nut 10 from rotating relative to the cast portion 24. A fastening bolt (not shown) may be screwed into the hole 12 of the cap nut 10 for fixing a component to the casting 23.

According to the above-described cap nut 10 and the casting method of the first preferred embodiment, the following advantageous effects are obtained.

(1-1) The cap nut 10 is removably installed in the pattern 19 and retained in the cast portion 24 made of the casting material. With the cap nut having the bolt 17 inserted therein set in the pattern 19, the processes from the formation of the sand mold 22 to the removal of the bolt 17 from the cap nut 10 are carried out in succession. According to the casting method, there is no need to prepare a bolt fitting that has been needed in the conventional casting method in addition to the cap nut, and there is no need to perform troublesome and time consuming work of replacing the bolt fitting with the cap nut during the casting operation.

(1-2) The cap nut 10 is held by the sand mold 22 through the bolt 17 inserted in the hole 12. In addition, a fastening bolt for fixing a component to the casting 23 is inserted into the cap nut 10 enveloped in the cast portion 24.

(1-3) The cap nut 10 has in the outer peripheral surface thereof the tapered surface 13 that broadens from the bottom surface 11*b* toward the exposed surface 11*a*. Thus, the cap nut 10 is easily removed from the pattern 19 after the sand mold 22 has been formed. The exposed surface 11*a* is larger in area than the bottom surface 11*b* and function as a seating face having a sufficiently large area. Thus, when a heavy component is to be fitted to the casting 23, a fastening bolt with a relatively large axial tension may be employed.

(1-4) The casting material is poured into the sand mold with the back surface of the locknut 18 as the cover member set in close contact with the exposed surface 11*a*, so that the casting material is not allowed to enter and reach the exposed surface 11*a*, thereby making it possible to use the exposed surface 11*a* as a seating face for fitting a component.

(1-5) The use of the locknut 18 screwed on the bolt 17 makes it possible to adjust the depth of insertion of the bolt 17 into the cap nut 10 in the increment of the thread pitch of the bolt. With the thermal expansion and contraction of the cap nut 10 and the ease of removal of the bolt 17 after casting taken into consideration, the bolt 17 may be inserted to a desired depth into the cap nut 10.

(1-6) The back surface of the locknut 18 is set in close contact with the exposed surface 11*a*, so that the bolt 17 is held securely in the cap nut 10 without being inclined relative to the cap nut 10.

The following will describe a second preferred embodiment of a cap nut to be enveloped in a casting and a casting method of enveloping the cap nut in the casting according to the present invention with reference to FIGS. 4 through 6C.

Figure 4A:
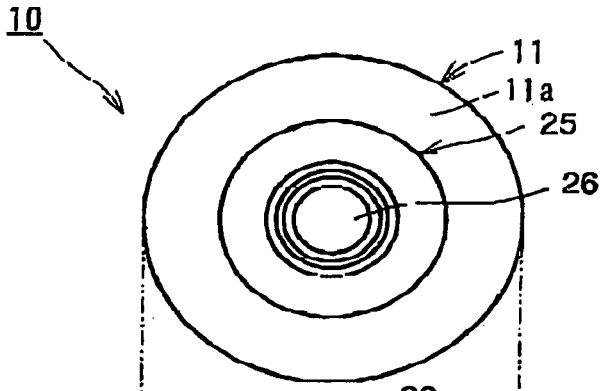
FIG. 4A through 4C respectively show a top view, a side view and a bottom view of a cap nut to be enveloped in a casting according to a second preferred embodiment.
Figure 4B:
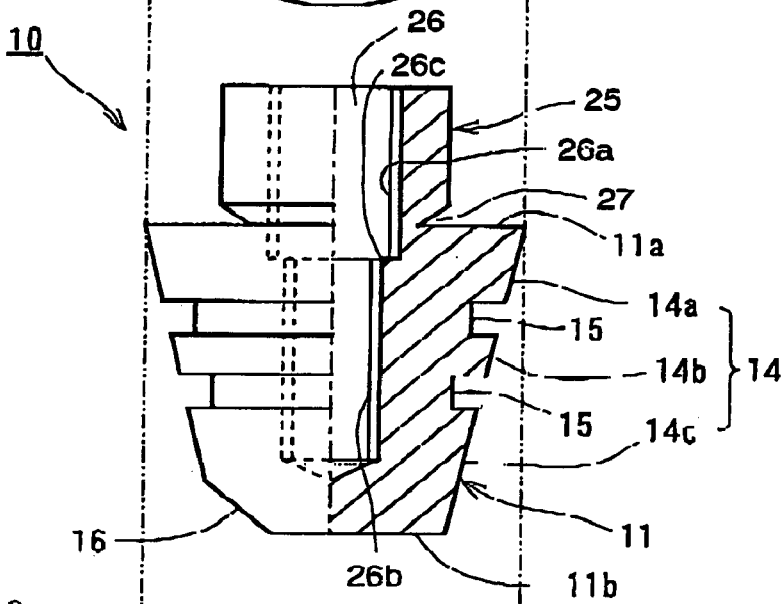
Figure 4C:
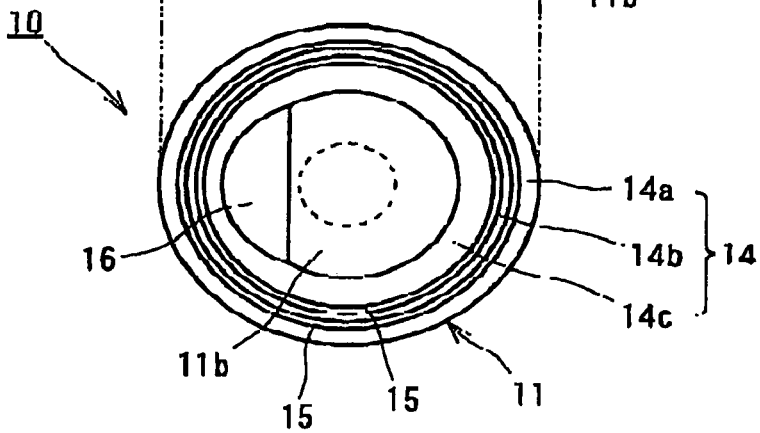

A cap nut 10 will be now described. As shown in FIGS. 4A through 4C, the cap nut 10 includes a cap nut body 11 and a cylindrical extension 25. The cap nut body 11 has substantially a truncated cone shape having a large-diameter end surface or an exposed surface 11*a* at one end (a first end) thereof and a small-diameter end surface or a bottom surface (a top end surface) 11*b* at the other end (a second end) thereof. The exposed surface 11*a* is to be exposed to the outside of a casting and functions as a seat surface for fitting a component. The bottom surface 11*b* is to be surrounded by casting material. The cap nut body 11 has formed in the outer peripheral surface thereof a tapered surface 14 (14*a*, 14*b*, 14*c*) that is tapered toward the bottom surface 11*b*, that is, broadens from the bottom surface 11*b* toward the exposed surface 11*a*. The cap nut body 11 has formed in the tapered surface 14 annular engaging grooves 15 spaced in axial direction of the cap nut body 11 parallel to each other, which function as retaining means for preventing the cap nut 10 from falling off from a cast portion 24 of a casting 23. The cap nut body 11 is formed with a planar inclined surface 16 extending between the bottom surface 11*b* and the tapered surface 14*c*. The inclined surface 16 functions as rotation prevention means for preventing the cap nut 10 from rotating relative to the cast portion 24 of the casting 23. The cap nut 10 is made of a ferrous material or a carbon steel. The cap nut 10 is to be enveloped in the cast portion 24 of the casting 23 with all surfaces of the cap nut 10 except its exposed surface 11*a* surrounded by the cast portion 24.

The extension 25 protrudes from the exposed surface 11*a* of the cap nut body 11. The cap nut 10 has formed therearound between the cap nut body 11 and the extension 25 a circumferential notch 27 having substantially a V-shaped cross-section for facilitating the work of shearing off the extension 25. The cap nut 10 has formed therein a hole 26 axially extending from the end of the extension 25 into the cap nut body 11. The hole 26 is formed with a stepped shape, having a small-diameter portion 26*a* on the bottom side and a large-diameter portion 26*b* on the opening side.

The hole 12 will be described more in detail. The large-diameter portion 20*a* extends from the opening of the hole 12 in the extension 25 into the cap nut body 11 past the exposed surface 11*a*. The large-diameter portion 26*a* has formed therein an internal thread for receiving therein a fixing member or bolt 17, which will be described later. Namely, the large-diameter portion 26*a* allows the bolt 17 to be screwed therein. The small-diameter portion 26*b* that is small in diameter than the large-diameter portion 26*a* extends from the large-diameter portion 26*a* toward the bottom surface 11*b*. The small-diameter portion 26*b* has formed therein an internal thread for receiving therein a fastening bolt (not shown) for fitting a component. Namely, the small-diameter portion 26*b* allows the fastening bolt to be screwed therein. A boundary 26*c* between the large-diameter portion 26*a* and the small-diameter portion 26*b* is located in the cap nut body 11 and adjacent to the extension 25.

Meanwhile, the bolt 17 is of a known type and includes a head 17*a* and a shank 17*b*. The shank 17*b* has formed thereon an external thread for engagement with the large-diameter portion 26*a* in the cap nut 10.

Figure 5A:
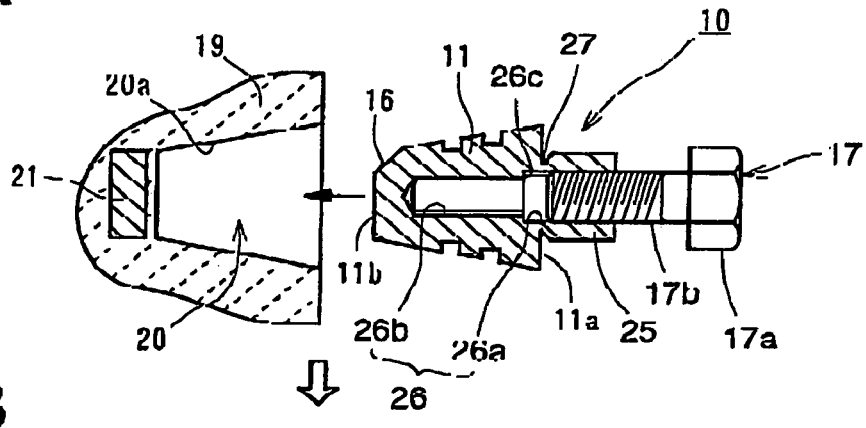
FIGS. 5A through 5C are explanatory views illustrating respective steps of procedure of a casting method before the pouring process in the casting method according to the second preferred embodiment.
Figure 5B:
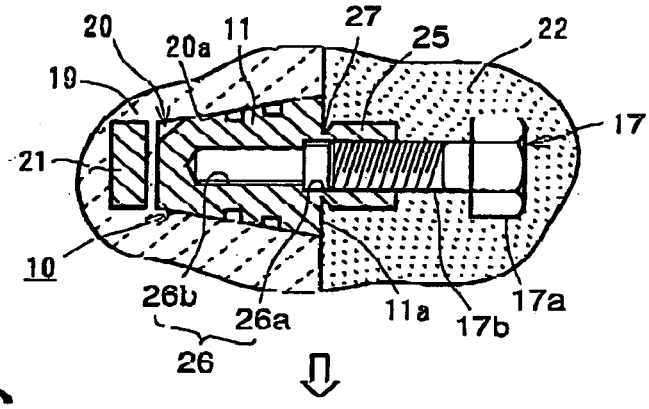

The casting method according to the second preferred embodiment will be now described with reference to FIGS. 5A through 6C. A pattern 19 that is used for forming a sand mold 22 has formed therein a recess 20 as shown in FIG. 5A. The recess 20 of the pattern 19 is formed with a tapered wall surface 20*a* which is complementary to the tapered surface 13 of the cap nut 10 so that the cap nut 10 is received snugly in the recess 20 of the pattern 10. The recess 20 is so formed that the surface of the pattern 19 adjacent to the recess 20 is flush with the exposed surface 11*a* of the cap nut 10 when it is fitted in the recess 20 as shown in FIG. 5B. A magnet 21 is buried in the mold 20 adjacent to the bottom of the recess 20, whose magnetic force acts on the cap nut 10 in the recess 20 so as to prevent the cap nut 10 from falling off from the recess 20, that is, so as to hold the cap nut 10 in the recess 20. Alternatively, adhesive or adhesive tape may be used to secure the cap nut 10 in the recess 20.

The shank 17*b* of the bolt 17 is inserted into the large-diameter portion 26*a* of the hole 12 of the cap nut 10 to such a depth that the distal end of the shank 17*b* remains in the extension 25 as shown in FIG. 5A. In the second preferred embodiment, the cap nut 10 with the bolt 17 is installed in the pattern 19 in such a way that the exposed surface 11*a* of the cap nut 10 is flush with the surface of the pattern 19, as shown in FIG. 5B. Alternatively, the bolt 17 is inserted into the cap nut 10 that has been already installed in the pattern 19.

Figure 5C:
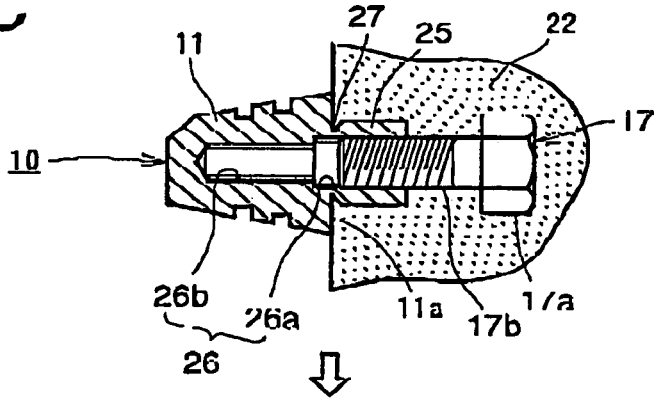

After installing the cap nut 10 in the pattern 19, the cavity of the pattern 19 is filled with molding sand for forming the sand mold 22 as shown in FIG. 5B. The extension 25, a portion of the shank 17*b* and a head 17*a* of the bolt 17 are covered with the molding sand and then buried in the sand mold 22. In the second preferred embodiment, the molding sand contains furan-based resin as hardener, so that the sand mold 22 made of such molding sand has strong shape retention after hardening. Accordingly, the sand mold 22 retains its shape without collapsing when it is removed from the pattern 19 as shown in FIG. 5C. The cap nut body 11 of the cap nut 10 protrudes from the sand mold 22 and is supported by the sand mold 22 through the bolt 17 and the extension 25. Since the pattern 19 has the sidewall surface 20*a* in the recess 20 for corresponding to the tapered surface 14 of the cap nut body 11 and the cap nut body 11 is held to the sand mold 22, the cap nut body 11 can be separated easily from the pattern 19 against the magnetic force of the magnet 21 in removing the pattern 19 from the sand mold 22.

Casting material or molten metal is subsequently poured into the sand mold 22. Cast iron is also used as the casting material in the second preferred embodiment. Alternatively, metals other than the ferrous metals, such as aluminum-based metals, copper-based metals are usable.

Figure 6A:
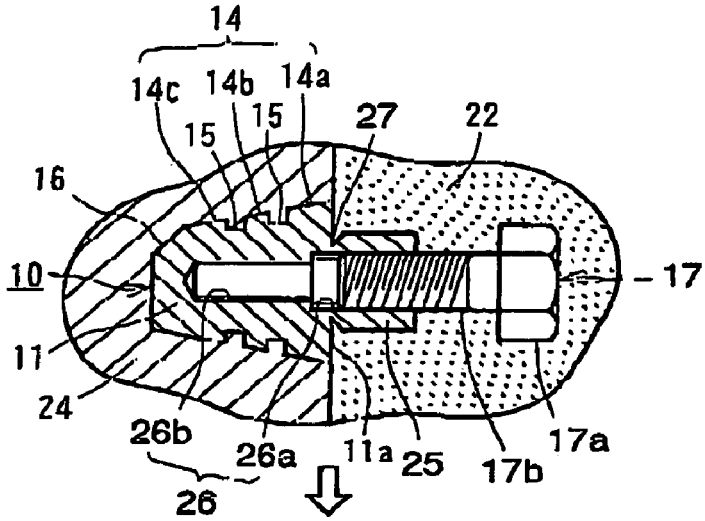
FIG. 6A through 6C are explanatory views illustrating respective steps of procedure of the casting method after the pouring process until finishing the casting in the casting method according to the second preferred embodiment.

As shown in FIG. 6A. the cap nut 10 is enveloped in the casting material with all surfaces thereof except its exposed surface 11*a* surrounded by the casting material. When the casting material is poured, the cap nut 10 expands due to the heat of the casting material, and the internal thread of the large-diameter portion 26*a* of the hole 26 of the cap nut 10, in which the bolt 17 is screwed, slightly deforms, accordingly. On the other hand, the small-diameter portion 26*b* of the hole 26 of the cap nut 10, in which no part of the bolt 17 is inserted, does not substantially deform. Meanwhile, because the exposed surface 11*a* of the cap nut body 11 and the surface of the sand mold 22 are in close contact with each other and the cap nut 10 includes the extension 25, the molten casting material does not reach the hole 26 of the cap nut 10.

Figure 6B:
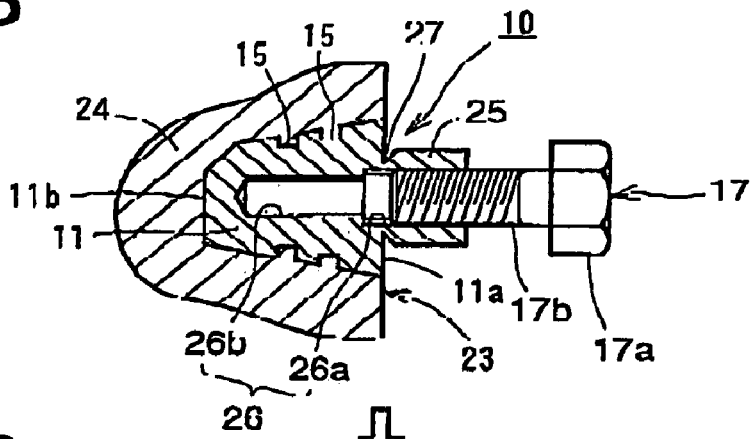

Pouring a predetermined amount of casting material into the sand mold 22, allowing the poured casting material to be cooled, and removing the sand mold 22 after the cooling, the casting 23 is then formed with the cap nut 10 enveloped therein, as shown in FIG. 6B. The cap nut 10 contracts during the cooling, so that the internal thread of the large-diameter portion 26*a*, which has deformed due to the thermal expansion, further deforms to be damaged. The resulting casting 21 has the cast portion 24 that is formed of the cooled casting material and the cap nut 10 that is enveloped in the cast portion 24 and that receives the bolt 17 in the extension 25 thereof.

Figure 6C:
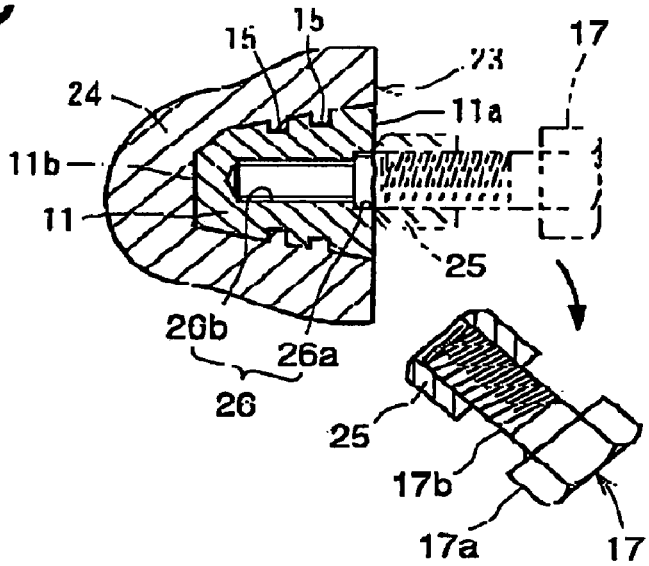

As shown in FIG. 6C, the extension 25 is sheared off from the cap nut body 11 by striking the head 17*a* of the bolt 17. By so doing, the extension 25 and the bolt 17 are removed from the cap nut body 11, and the casting 23 is completed. The sheared surface of the cap nut body 11 is often uneven and, therefore, it needs to be finished by smoothing so that the smoothened surface is flush with the exposed surface 11*a*. The exposed surface 11*a* and the outer peripheral surface of the cast portion 24 are substantially flush with each other. The bolt 17 removed with the extension 25 may be reused several times as the fixing member.

The cap nut 10, which is enveloped in the cast portion 24, does not fall off from the cast portion 24 due to the engagement between the engaging grooves 15 of the cap nut body 11 and the cast portion 24. The provision of the inclined portion 16 in the cap nut body 11 prevents the cap nut 10 from rotating relative to the cast portion 24. A fastening bolt (not shown) may be screwed into the hole 12 of the cap nut 10 for fixing a component to the casting 23.

According to the above cap nut 10 and the casting method of the second preferred embodiment, the following advantageous effects are obtained. Substantially the same advantageous effect is also obtained as mentioned in the paragraph (1-1) with reference to the first preferred embodiment.

(2-1) The casting material poured into the sand mold 22 envelopes the cap nut 10. However, the extension 25 and the bolt 17 prevent the casting material from entering the hole 26 of the cap nut body 11, so that the seizure between the cap nut 10 and the bolt 17 during the pouring is prevented.

(2-2) The small-diameter portion 26*b* is free from damage, so that it can receive therein the fastening bolt immediately after the removal of the bolt 17 and the extension 25 from the cap nut body 11 by shearing. The deformation of the large-diameter portion 26*a* by the expansion and the contraction of the cap nut 10 has no adverse effect on the function of the small-diameter portion 26*b*. By smoothening the sheared surface of the cap nut body 11, the casting 23 is completed with the cap nut body 11 enveloped therein.

(2-3) In order to facilitate the shearing of the extension 25, the portion of the cap nut 10 that corresponds to the notch 27 is made thinner. Any burr formed around the large-diameter portion 26*a* upon shearing does not prevent the fastening bolt from being screwed into he small-diameter portion 26*b*.

(2-4) The cap nut body 11 has a truncated cone shape, and the extension 25 is smaller in outer diameter than the end surface or the exposed surface 11*a* of the cap nut body 11 adjacent to the notch 27, thus the cap nut body 11 being provided with sufficient area of seating face or the exposed surface 11*a* for fixing a component to the casting 23. Thus, when a heavy component is to be fitted to the casting 23, a fastening bolt with a relatively large axial tension may be employed.

(2-5) Since the cap nut 10 is made of a ferrous material and the magnet 21 is buried in the pattern 19, the cap nut 10 is installed steadily in the pattern 19 due to the magnetic force of the magnet 21, which facilitates the work of installing the cap nut 10 in the pattern 19. Accordingly, the work time is shortened.

The present invention is not limited to the embodiments described above, but may be modified into the following alternative embodiments.

Figure 7:
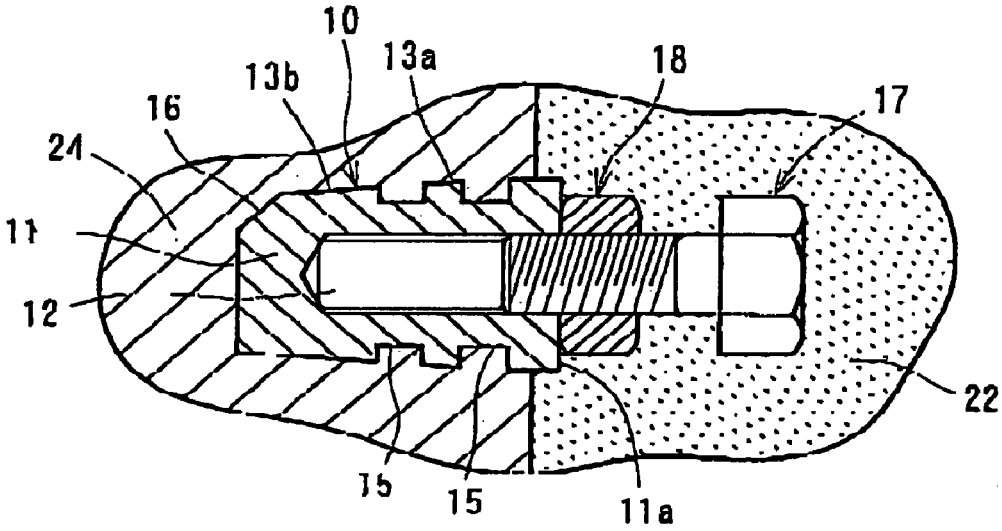
FIG. 7 is a cross-sectional view illustrating a state where a cap nut is enveloped in a casting according to an alternative embodiment of the present invention.
Figure 8:
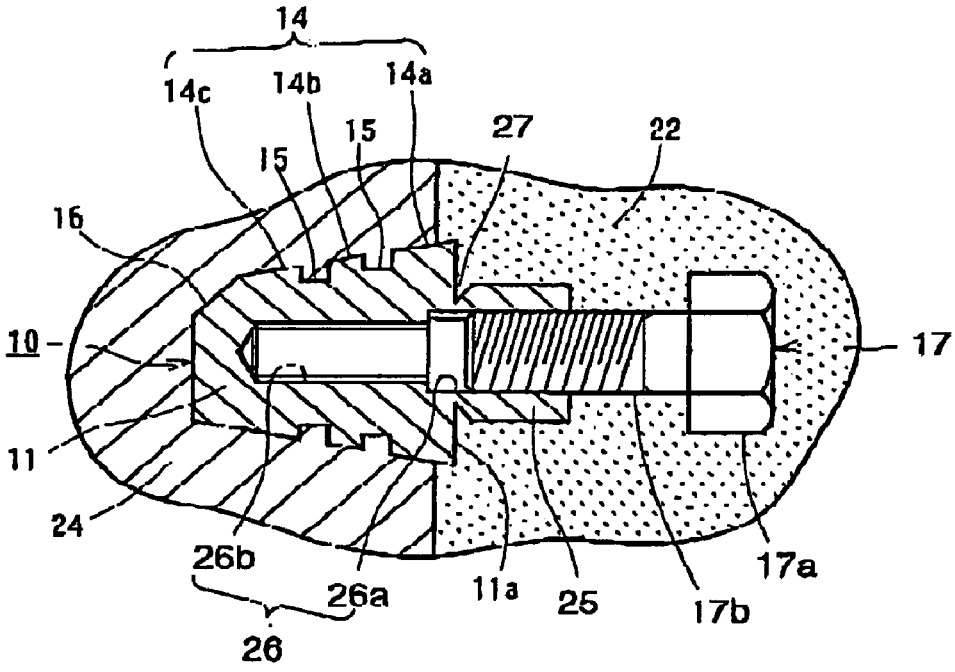
FIG. 8 is a cross-sectional view illustrating a state where a cap nut is enveloped in a casting according to an alternative embodiment of the present invention.

In the above first and second preferred embodiments, the exposed surface 11*a*, which is exposed on the surface of the cast portion 24, is substantially flush with the outer peripheral surface of the cast portion 24. It is so arranged, however, that the exposed surface 11*a* may protrude from the outer peripheral surface of the cast portion 24 as shown in FIGS. 7 and 8. Alternatively, the exposed surface 11*a* may be provided so as to be recessed from the outer peripheral surface of the cast portion 24 (not shown). In the case of a modification from the first preferred embodiment, it is preferable that the locknut 18 should be fitted to the bolt 17 in such a way that the locknut 18 is set in close contact with the exposed surface 11*a* so that the casting material does not enter to reach the external thread of the bolt 17. By arranging the exposed surface 11*a* of the cap nut 10 in a plane that is different from that of the outer peripheral surface of the cast portion 24, the casting 23 can meet a wider range of requirements of components that are to be fitted to the casting 23.

Figure 9:
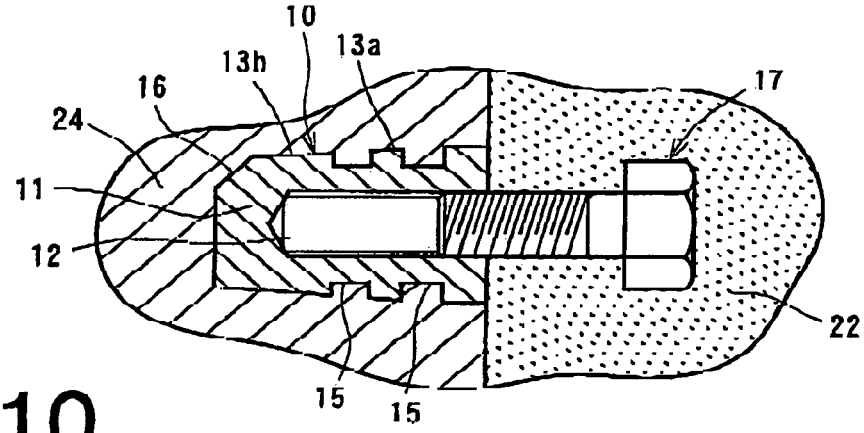
FIG. 9 is a cross-sectional view illustrating a state where a cap nut is enveloped in a casting according to an alternative embodiment of the present invention.

In the above first preferred embodiment, the lock nut 18 is used as the cover member and is fitted on the bolt 17 that is to be inserted into the cap nut 10. If the cap nut 10 is stably fitted on the bolt 17 without using the lock nut 18 and does not substantially incline relative to the bolt 17, the lock nut 18 as the cover member is omitted as shown in FIG. 9. In this case, the work of fitting the lock nut 18 on the bolt 17 is unnecessary and hence omitted. In addition, members or parts required in the casting are reduced, thereby reducing the manufacturing cost of the casting 23.

Figure 10:
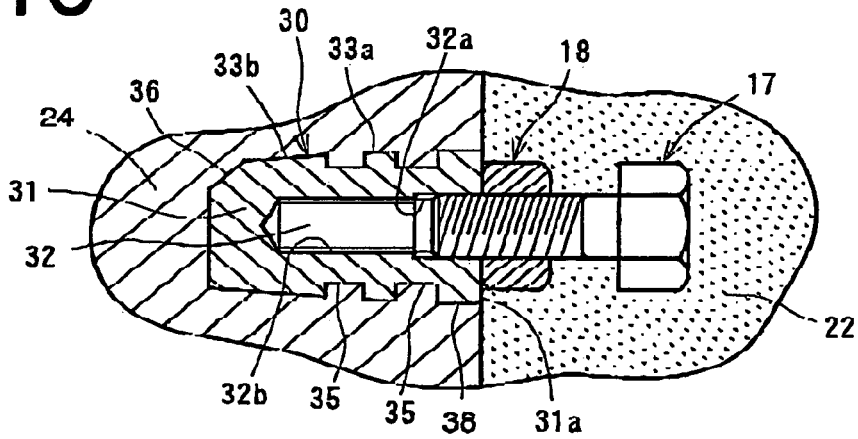
FIG. 10 is a cross-sectional view illustrating a state where a cap nut is enveloped in a casting according to an alternative embodiment of the present invention.

A cap nut 30 shown in FIG. 10 is used instead of the cap nut 10 of the above fist preferred embodiment. The cap nut 30 has formed therein a stepped hole 32 that includes a large-diameter portion 32*a* on the side of an exposed surface 31*a* and a small-diameter portion 32*b* on the side of a bottom surface 31*b*. The large-diameter portion 32*a* is formed for receiving therein the bolt 17 and the small-diameter portion 32*b* is formed for receiving therein the fastening bolt. In this case, even if seizure occurs between the large-diameter portion 32*a* and the bolt 17 during the casting, the small-diameter portion 32*b* is free from damage. Thus, the fastening bolt is inserted into the small-diameter portion 32*b* after the casting 23 has been made. Other parts of the cap nut 30 such as tapered surface 33, vertical surface 38, engaging grooves 35 and inclined surface 36 are similar to their corresponding parts of the cap nut 10 of the above first preferred embodiment.

Figure 11:
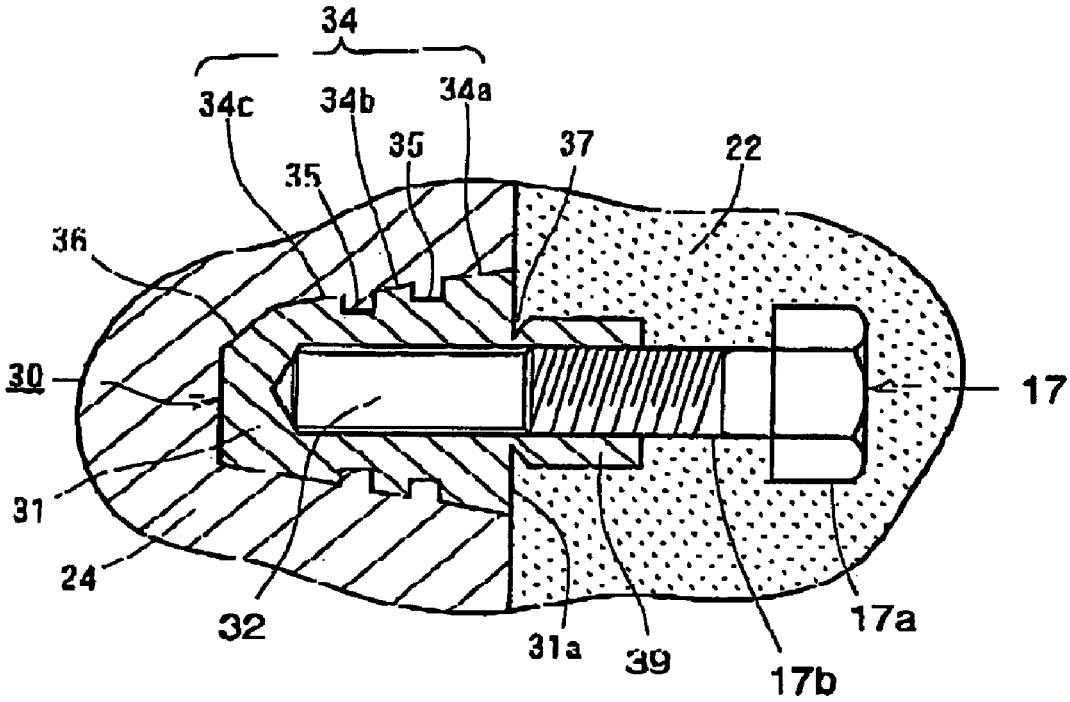
FIG. 11 is a cross-sectional view illustrating a state where a cap nut is enveloped in a casting according to an alternative embodiment of the present invention.
Figure 12A:
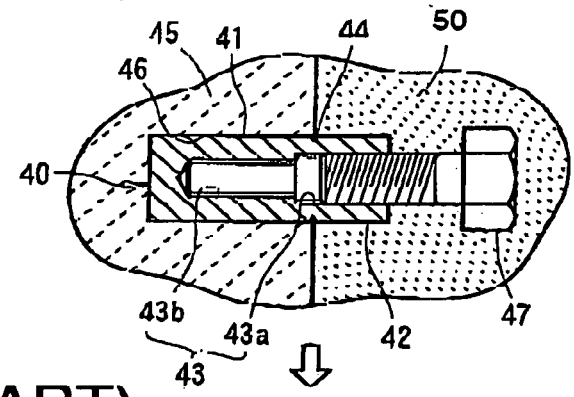
FIG. 12A (PRIOR ART)
FIGS. 12A through 12C are explanatory views illustrating respective steps of procedure of a casting method after the pouring process until finishing the casting in the casting method according to prior art.
Figure 12B:
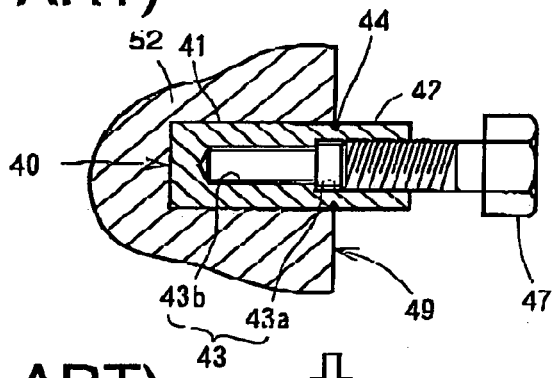
FIG. 12B (PRIOR ART)
Figure 12C:
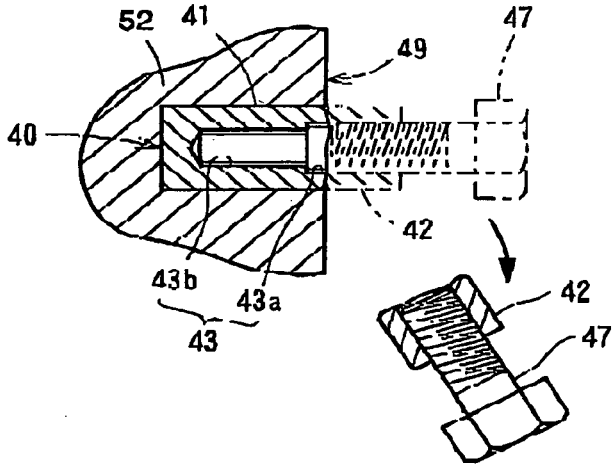
FIG. 12C (PRIOR ART)
Figure 13A:
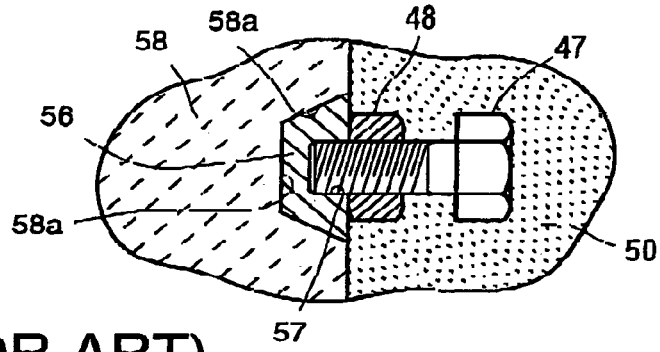
FIG. 13A (PRIOR ART)
FIGS. 13A through 13C are explanatory views illustrating respective steps of procedure of a casting method until fitting a cap nut to a sand mold in the casting method according to prior art.
Figure 13B:
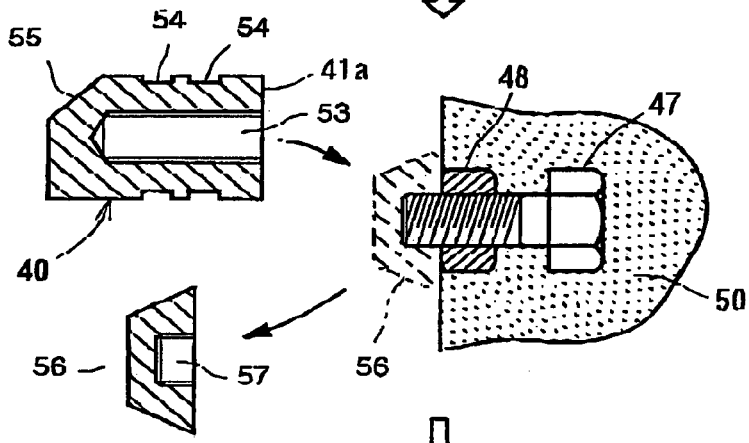
FIG. 13B (PRIOR ART)
Figure 13C:
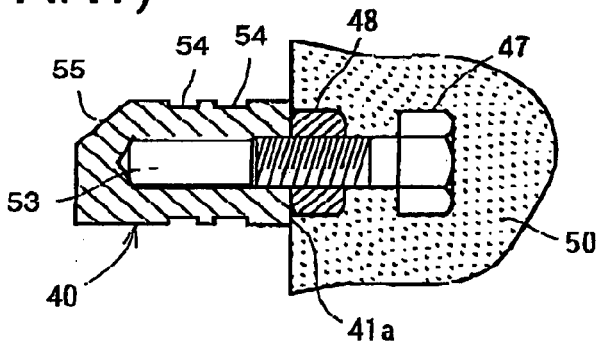
FIG. 13C (PRIOR ART)
Figure 14A:
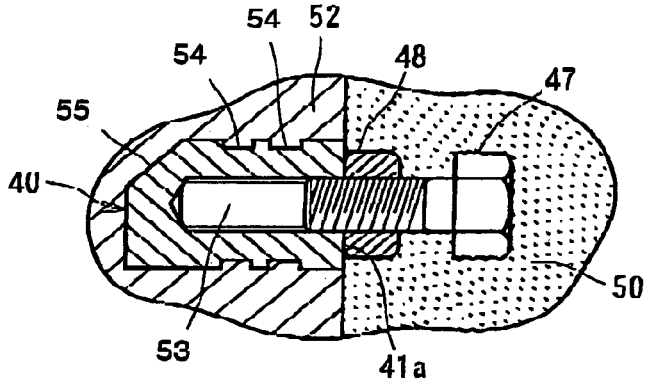
FIG. 14A (PRIOR ART)
FIGS. 14A through 14C are explanatory views illustrating respective steps of procedure of the casting method after the pouring process until finishing the casting in the casting method according to the prior art.
Figure 14B:
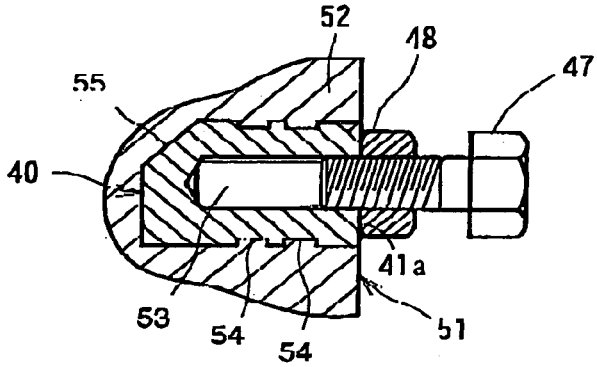
FIG. 14B (PRIOR ART)
Figure 14C:
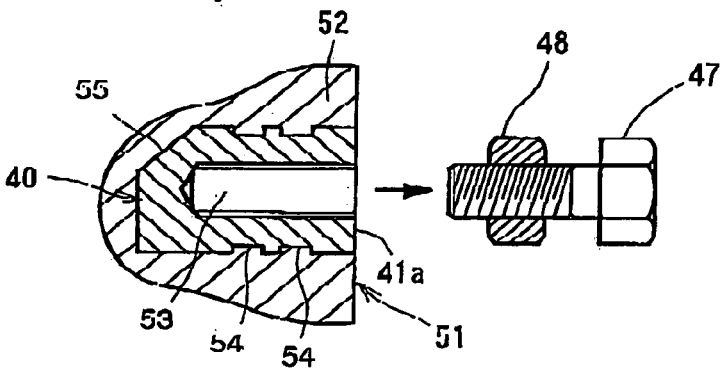
FIG. 14C (PRIOR ART)

A cap nut 30 shown in FIG. 11 is used instead of the cap nut 10 of the above second preferred embodiment. The cap nut 30 has formed therein a cylindrical threaded hole 32 having the same diameter throughout its length, and the shank 17*b* of the bolt 17 has substantially the same diameter as the shank of the fastening bolt (not shown). FIG. 11 shows the state where the bolt 17 is inserted into the hole 32. In the case of the cap nut 30, the sheared surface and the adjacent part of the hole 32 need to be finished after shearing a cap nut body 31 and an extension 39. Other parts of the cap nut 30 such as tapered surface 34 (34*a*, 34*b*, 34*c*), engaging grooves 35, inclined surface 36 and notch 37 are similar to their corresponding parts of the cap nut 10 of the above second preferred embodiment.

In the above first and second preferred embodiments, the angle of the tapered surface of the cap nut has not been explained. In order to successfully remove the cap nut from the pattern, the angle between the tapered surface and the axis of the hole of the cap nut may be set at not less than 2°. The angle may range from 3.5° to 40° for practical application of the cap nut.

In the above first and second preferred embodiments, the cap nut has formed on the outer peripheral surface thereof the engaging grooves as the retaining means. The grooves may be dispensed with, however, when a bolt to be inserted into the small-diameter portion of the cap nut for fitting a component to the casting has a small fastening force. In this alternative embodiment, machining of the cap nut for providing the grooves may be omitted, thus the cost of the casting being further reduced. Meanwhile, the number of the engaging grooves is not limited to two, and may be at least one.

The retaining means is not limited to the engaging grooves. In an alternative embodiment, any retaining means may be used as far as it is capable of performing the function of preventing the cap nut from falling off from the cast portion of the casting. For example, a protrusion provided on the outer peripheral surface of the cap nut may be used as the retaining means.

In the above first and second preferred embodiments, the engaging grooves or the retaining means on the outer peripheral surface of the cap nut and the inclined surface of the rotation prevention means on the bottom thereof are formed separately. In an alternative embodiment, the cap nut is formed to have a protrusion or a notch that doubles as the retaining means and the rotation prevention means.

Though the description of the above first and second preferred embodiments has not referred to usage of the castings, the present invention is applicable to manufacturing of a counterweight for an industrial vehicle and a large-size press die used for stamping vehicle parts.

As apparent from the foregoing, a casting having a cap nut enveloped therein and a method of making such casting according to the present invention are advantageously applicable to the manufacture of large-size or heavy parts which are difficult to handle and, therefore, have formed therein many cap nuts as fitting members.

The above first and second preferred embodiments have been described with reference to a casting method in which the cap nut is installed in the pattern for forming sand mold. However, the present invention may be applicable to a full mold process using an evaporative pattern. Which pattern should be used, ordinary pattern or evaporative pattern, should be determined based on the number of castings to be produced. Accordingly, the cap nut for envelopment casting is widely used.

Therefore, the present examples and embodiments are to be considered as illustrative and not restrictive, and the invention is not to be limited to the details given herein but may be modified within the scope of the appended claims.

What is claimed is:

1. A cap nut to be enveloped in a casting made of casting material, comprising:

a substantially cylindrical body having a first end and a second end adjacent to a top end surface of the body, the body having a hole and an outer peripheral surface to be enveloped in the casting material, the body having an exposed surface adjacent to the hole at the first end thereof, the exposed surface being exposed to an outside of the casting, the body having formed in the outer peripheral surface thereof a tapered surface that broadens from the second end of the body toward the first end, the body having formed in the tapered surface a retaining means for preventing the cap nut from falling off from the casting, wherein the body is installable in and removable from a pattern for forming a sand mold at the tapered surface; and a cylindrical extension protruding from the exposed surface of the body for being buried in the sand mold, the hole extending through the extension, the cap nut having formed therearound between the body and the extension a circumferential notch having substantially a V-shaped cross-section.

2. The cap nut according to claim 1, wherein the hole allows a fastening bolt to be screwed therein, the hole allowing a fixing member that is to be supported by the sand mold to be screwed therein.

3. The cap nut according to claim 2, wherein the hole has a stepped shape and includes a large-diameter portion on an opening side for receiving the fixing member and a threaded small-diameter portion on a bottom side for receiving the fastening bolt.

4. The cap nut according to claim 1, wherein the body has a non-tapered peripheral surface between the tapered surface and the exposed surface, the non-tapered peripheral surface being parallel to an axis of the body.

5. The cap nut according to claim 1, wherein the hole has a stepped shape and includes a large-diameter portion on an opening side and a threaded small-diameter side on a bottom side, a border between the large-diameter portion and the small-diameter portion being located in the body and adjacent to the notch.

6. The cap nut according to claim 1, wherein an outer diameter of the extension is smaller than that of the exposed surface.

7. The cap nut according to claim 1, wherein a rotation prevention means is provided in the body for preventing the cap nut from rotating relative to the casting.

8. The cap nut according to claim 7, wherein the rotation prevention means is an inclined surface formed in the body between the second end and the tapered surface.

9. The cap nut according to claim 1, wherein the retaining means is an engaging groove.

10. A casting comprising:

a cast portion made of casting material, the cast portion having an outer peripheral surface; and a cap nut enveloped in the cast portion, the cap nut including:

a substantially cylindrical body having a first end and a second end, the body having a hole and an outer peripheral surface to be enveloped in the casting material, the body having an exposed surface adjacent to the hole at the first end thereof, the exposed surface being exposed to an outside of the casting, the body having formed in the outer peripheral surface thereof a tapered surface that broadens from the second end of the body toward the first end, the body having formed in the tapered surface a retaining means for preventing the cap nut from falling off from the casting, wherein the body is installable in and removable from a pattern for forming a sand mold at the tapered surface; and a cylindrical extension protruding from the exposed surface of the body for being buried in the sand mold, the hole extending through the extension, the cap nut having formed therearound between the body and the extension a circumferential notch having substantially a V-shaped cross-section.

11. The casting according to claim 10, wherein the exposed surface is substantially flush with the outer peripheral surface of the cast portion.

12. The casting according to claim 10, wherein the exposed surface and the outer peripheral surface of the cast portion are on different planes.

* * * * *

UNITED STATES PATENT AND TRADEMARK OFFICE

CERTIFICATE OF CORRECTION

PATENT NO. : 7,255,930 B2
APPLICATION NO. : 11/099129
DATED : August 14, 2007
INVENTOR(S) : Takahito Miyake et al.

It is certified that error appears in the above-identified patent and that said Letters Patent is hereby corrected as shown below:

In the Specification

Column 1, line 58, please delete "nut body 40a" and insert therefore -- nut body 41 -- ;

Column 1, line 59, please delete "cylindrical extension 50b" and insert therefore -- cylindrical extension 42 -- ;

Column 2, lines 3-4, please delete "cap nut 40 enveloped" and insert therefore -- cap nut 40 is enveloped -- ;

Column 2, line 5, please delete "cap nut 50." and insert therefore -- cap nut 40. -- ;

Column 2, line 7, please delete "cylindrical extension 43b" and insert therefore -- cylindrical extension 42 -- ;

Column 2, line 8, please delete "the body 43a" and insert therefore -- the body 41 -- ;

Column 2, line 10, please delete "nut body 43a" and insert therefore -- nut body 41 -- ;

Column 2, line 13, please delete "threaded hole 43a" and insert therefore -- threaded hole 43b -- ;

Column 2, line 45, please delete "The bolt mold 56" and insert therefore -- The fitting 56 -- ;

Column 3, line 15, please delete "cap nut 40 enveloped" and insert therefore -- cap nut 40 is enveloped -- ;

Column 4, line 28, please delete "FIG. 1A through 1C" and insert therefore -- FIGS. 1A through 1C -- ;

Column 4, line 39, please delete "FIG. 4A through 4C" and insert therefore -- FIGS. 4A through 4C -- ;

Column 4, line 46, please delete "FIG. 6A through 6C" and insert therefore -- FIGS. 6A through 6C -- ;

Column 5, line 30, please delete "initial thread 12a" and insert therefore -- internal thread 12a -- ;

UNITED STATES PATENT AND TRADEMARK OFFICE

CERTIFICATE OF CORRECTION

PATENT NO. : 7,255,930 B2
APPLICATION NO. : 11/099129
DATED : August 14, 2007
INVENTOR(S) : Takahito Miyake et al.

It is certified that error appears in the above-identified patent and that said Letters Patent is hereby corrected as shown below:

Column 6, line 8, please delete “pattern 10.” and insert therefore -- pattern 19. -- ;

Column 6, line 9, please delete “the mold 20” and insert therefore -- the mold 22 -- ;

Column 6, line 17, please delete “protrudes from the locknut 17” and insert therefore -- protrudes from the locknut 18 -- ;

Column 6, line 21, please delete “with the back surface” and insert therefore -- with a back surface -- ;

Column 6, line 58, please delete “of the locknut 16” and insert therefore -- of the locknut 18 -- ;

Column 8, line 41, please delete “small-diameter portion 26a” and insert therefore -- small-diameter portion 26b -- ;

Column 8, line 42, please delete “large-diameter portion 26b” and insert therefore -- large-diameter portion 26a -- ;

Column 8, line 43, please delete “The hole 12” and insert therefore -- The hole 26 -- ;

Column 8, lines 43-44, please delete “The large-diameter portion 20a” and insert therefore -- The large-diameter portion 26a -- ;

Column 8, lines 44-45, please delete “the hole 12 in” and insert therefore -- the hole 26 in -- ;

Column 8, lines 50-51, please delete “that is small” and insert therefore -- that is smaller -- ;

Column 9, line 5, please delete “recess 20 of the pattern 10” and insert therefore -- recess 20 of the pattern 19 -- ;

Column 9, line 9, please delete “mold 20 adjacent to” and insert therefore -- mold 22 adjacent to -- ;

Column 9, line 16, please delete “of the hole 12” and insert therefore -- of the hole 26 -- ;

UNITED STATES PATENT AND TRADEMARK OFFICE

CERTIFICATE OF CORRECTION

PATENT NO. : 7,255,930 B2
APPLICATION NO. : 11/099129
DATED : August 14, 2007
INVENTOR(S) : Takahito Miyake et al.

It is certified that error appears in the above-identified patent and that said Letters Patent is hereby corrected as shown below:

Column 9, line 38, please delete "pattern 19 has the sidewall surface" and insert therefore -- pattern 19 has the tapered wall surface -- ;

Column 10, lines 5-6, please delete "The resulting casting 21" and insert therefore -- The resulting casting 23 -- ;

Column 10, line 27, please delete "into the hole 12" and insert therefore -- into the hole 26 -- ;

Column 10, line 54, please delete "into he small-diameter" and insert therefore -- into the small-diameter -- ;

Column 10, line 59, please delete "cap nut body 11 being" and insert therefore -- cap nut body 11 is -- ;

Column 11, lines 26, 29, 30-31 and 32, please delete "the lock nut 18" and insert therefore -- the locknut 18 -- ;

Column 11, line 37, please delete "the above fist preferred embodiment." and insert therefore -- the above first preferred embodiment -- ; and Column 12, line 16, please delete "casting being further reduced." and insert therefore -- casting is further reduced. -- .

Signed and Sealed this

Twenty-ninth Day of December, 2009

David J. Kappos

David J. Kappos
*Director of the United States Patent and Trademark Office*